United States Patent [19]

Betta

[11] 4,380,949

[45] Apr. 26, 1983

[54] BRAIDED STRANDED ROPE FORMING MACHINE

[75] Inventor: Walter Betta, Bergamo, Italy

[73] Assignee: Wabing S.r.l., Bergamo, Italy

[21] Appl. No.: 196,492

[22] Filed: Oct. 14, 1980

[30] Foreign Application Priority Data

Oct. 26, 1979 [IT] Italy ..... 2934 A/79

[51] Int. Cl.[3] ..... D04C 3/40; D04C 3/42

[52] U.S. Cl. ..... 87/48; 87/29

[58] Field of Search ..... 87/29, 33, 44, 47, 48

[56] References Cited

U.S. PATENT DOCUMENTS

| | | | |
|---|---|---|---|
| 1,921,174 | 8/1933 | Tober | 87/48 |
| 4,034,642 | 7/1977 | Iannucci et al. | 87/48 |
| 4,034,643 | 7/1977 | Iannucci et al. | 87/48 |

*Primary Examiner*—John Petrakes

[57] ABSTRACT

Braided stranded rope forming machine comprising a series of spools moving along a circular path and a series of stationary spools that can be mounted also at a distance from the machine. The movable spools are mounted on carriages which through a gearing unit are operated by the same vertical axis controlling the thread guide devices associated with the stationary spools.

5 Claims, 5 Drawing Figures

BRAIDED STRANDED ROPE FORMING MACHINE

This invention is concerned with a machine designed for forming braided stranded ropes, comprising a series of spools moving along a circular path and a series of stationary spools having a respective device associated therewith for alternately shifting the thread inside and outside of the circular path.

It is well known in some fields of the art that, when using ropes or cables of considerable length to lift or draw loads, such conditions may arise in the ropes or cables as to render the latter shortly unusable due to instability. One of these cases occur when the wires of aerial electrical lines are installed, where a traction rope or cable is laid out beforehand. Such a rope or cable is torsionally stressed during its passage on winches and pulleys, so that if of spirally coiled type, such a rope or cable experiences a rapid wear.

A rope or cable safely enduring such a type of work is a braided stranded rope or cable, that is to say a cable or rope comprising strands, each of which braiding with all of the other strands so as to form an assembly fully inert to or free of torsion.

However, braided stranded ropes or cables are not widely used in the art, because the hitherto known forming machines therefor are very slow and accordingly exhibit a much higher cost of production than those for producing spiroidal ropes or cables.

Thus, the machines at present known for forming braided stranded ropes or cables are divided into a first type, in which the strand containing spools move along two looped paths interlacing as an "eight" to each other, or into a type in which the spools arranged on a circular path and those arranged on an eliptical path would intersect one another.

In the first case, the spools move along complex paths requiring the provision or introduction of switches and the like, with considerable slowness in operation, machine complexity and such disadvantages.

In the second case, inertial forces would arise and limit the work rate. Additionally, in both cases, since all of the spools are moving, when having to provide for even the slightest operation, such as repairs and the like, the whole machine has to be shut down, with a resulting increase in dead times.

It is the object of the present invention to provide a novel braided stranded rope or cable forming machine, capable of overcoming the above mentioned disadvantages, enabling a considerable high working rate and accordingly a reduced cost of production, with high reliability and operation simplicity, in addition to flexibility and ready adaptability to forming ropes of cables of any number of strands.

This is accomplished in that a machine according to the present invention comprises a series of spools moving along a circular path and a series of stationary spools cooperating therewith, wherein the thread is alternately shifted inside and outside of the circular path by a respective thread guide device, one for each of the stationary spools, controlled by a respective rotating member rotably driven by the same axis or shaft rotating said series of moving spools.

By such an expedient, the following whole series of advantages are provided:

(1) Only one series of spools is moving and thus the moment of inertia of the machine is reduced to at least one half.

(2) The moving spools travel along a circular path and being subjected to only the centrifugal acceleration may reach higher speeds.

(3) The spools free of movement may be even of considerable dimensions because of not having to be necessarily mounted on the machine. This particular feature would substantially reduce the dead times resulting from the spool replacement at the end of the operating cycle. Moreover, any still spool at that time not being used, may be subjected to possible operations without having to stop the entire machine.

According to the invention, it is also provided that the axis or shaft for controlling the moving spools and thread guide devices is internally hollow in order that the possible rope or cable core be provided therein.

An unrestrictive embodiment of the invention will now be further described in connection with the accompanying drawings, in which.

Figure 1:
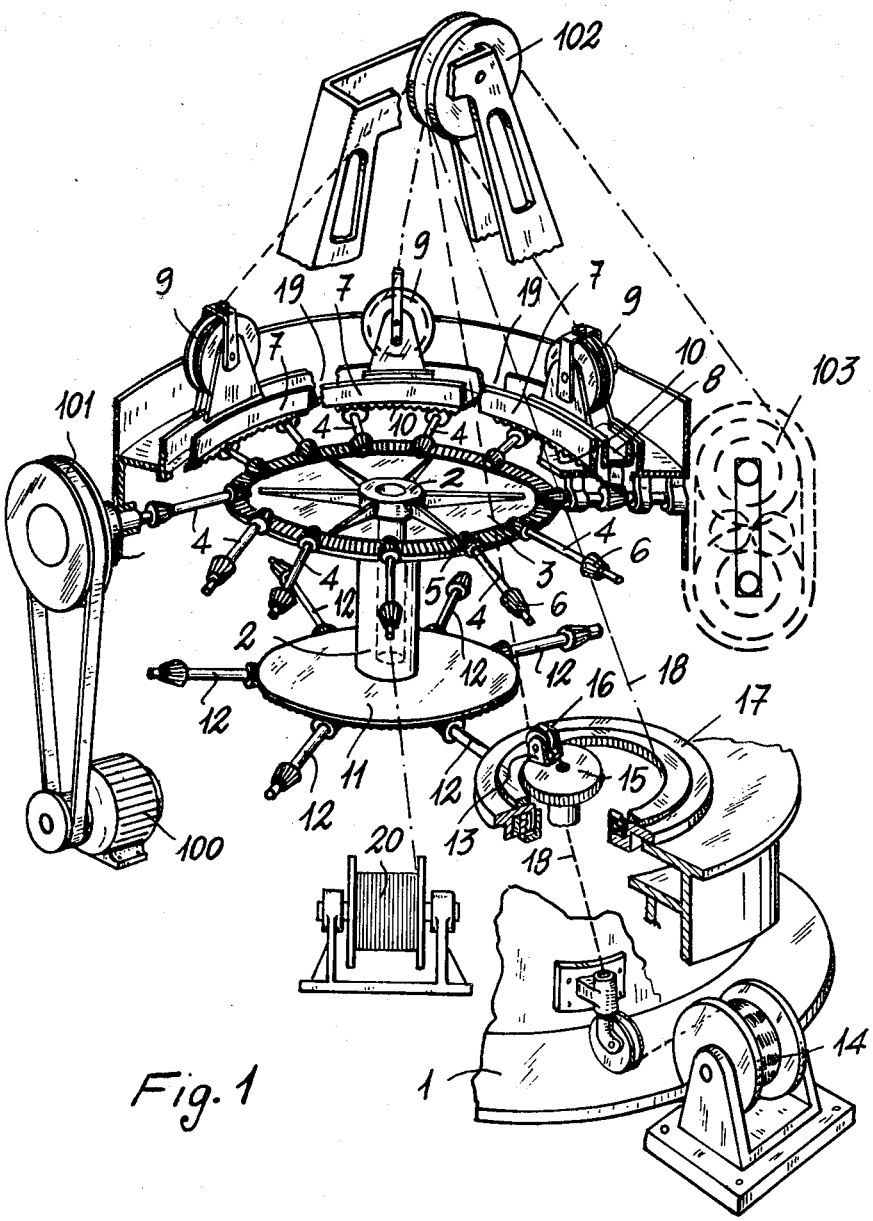
FIG. 1 is a schematic perspective view showing the machine according to the invention.
Figure 2:
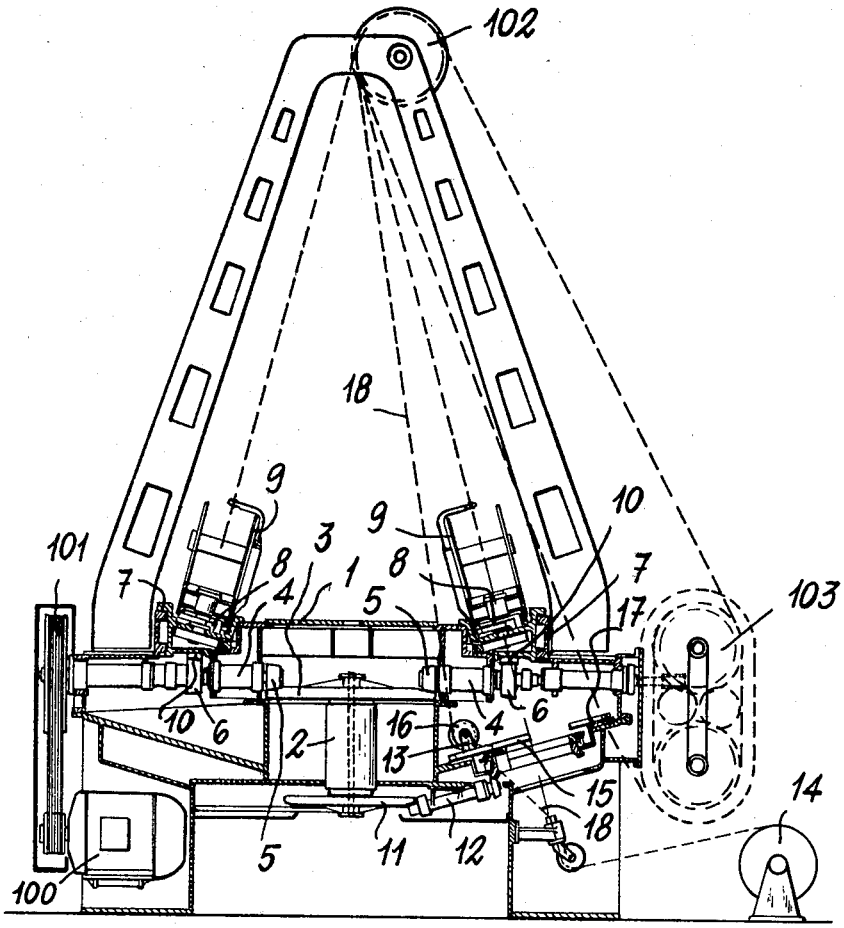
FIG. 2 is a sectional view of the machine shown in FIG. 1.
Figure 3:
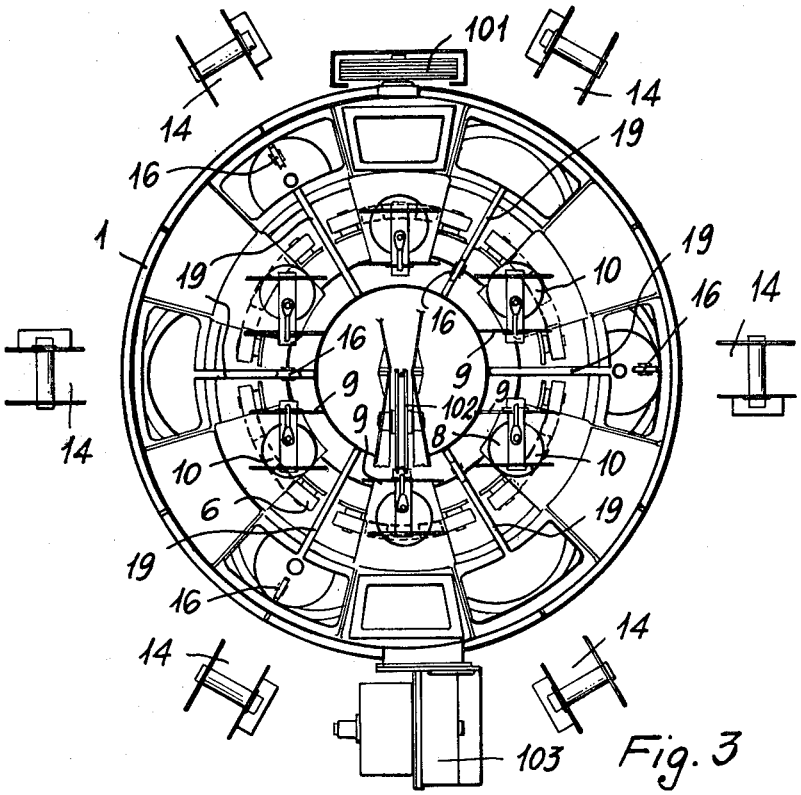
FIG. 3 is a plan view showing the machine according to the invention.

Referring now to the drawings, and particularly to FIGS. 1, 2 and 3, reference numeral 1 denotes a frame carrying a rotating vertical axis or shaft 2, having applied thereon a bevel gear wheel 3 driving a series of horizontal axes or shafts 4, in this particular case in number of twelve. The drive is through a unit shown at 100 and 101, that is a unit comprising a motor and a transmission or drive representing any operating and controlling means. Each of said axes or shafts 4, which are radially and equidistantly located on said gear wheel 3, have at the two ends of the axis or shaft mounted thereon a respective pinion 5, 6, so arranged that the total of the twelve pinions 6 form a circular path or track.

Parallel to such a circular path or track, the machine frame has prismatic guides 7, having slidable therein a number of carriages 8 (in this case in number of six) carrying a spool 9 of the strand spool series, respectively. To the bottom of each of said carriages 8, there is applied a sector of bevel gear crown or ring 10 for always meshing with at least two of pinions 6 of said circular path or track.

Figure 4:
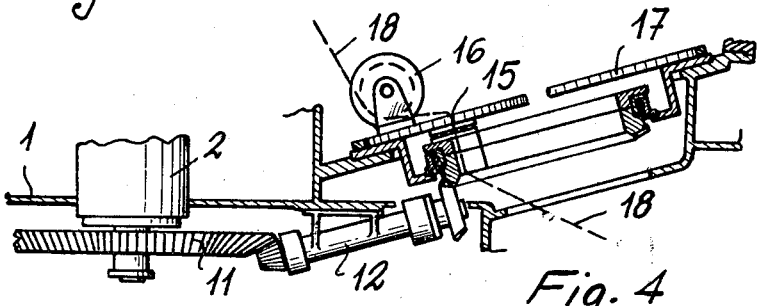
FIGS. 4 and 5 are detailed views showing the thread guide device and carriage for the moving spools, respectively.

At its bottom, said vertical axis or shaft 2 driving the machine carries a second gear ring 11 similar to the above described gear ring 3. Through six radial shafts 12, this gear ring 11 drives as many devices shown at 13 (and better shown in FIG. 4), serving the purpose of alternately shifting the strands from the stationary spools 14 from inside to outside of the circular path or track traveled by the moving spools 9. Such an alternate motion is provided by a circular motion of a pinion or gear 15, having mounted thereon the thread guide pulley 16, which pinion or gear 15 rolls within the interior of a gear ring 17 having internal toothing and being of a double pitch diameter than that of gear 15. Therefore, as it will be readily appreciated, should a circumference rotate within another circumference of a double diameter, its two poles related to the vertical axis would for each revolution describe the two orthogonal diameters of the major circumference.

Therefore, the rotation of pinion or gear 15 displaces the thread guide pulley 16 connected thereto, causing it to describe a rectilinear path orthogonally intersecting the circular path or track on which said moving spools 9 are mounted.

Figure 5:
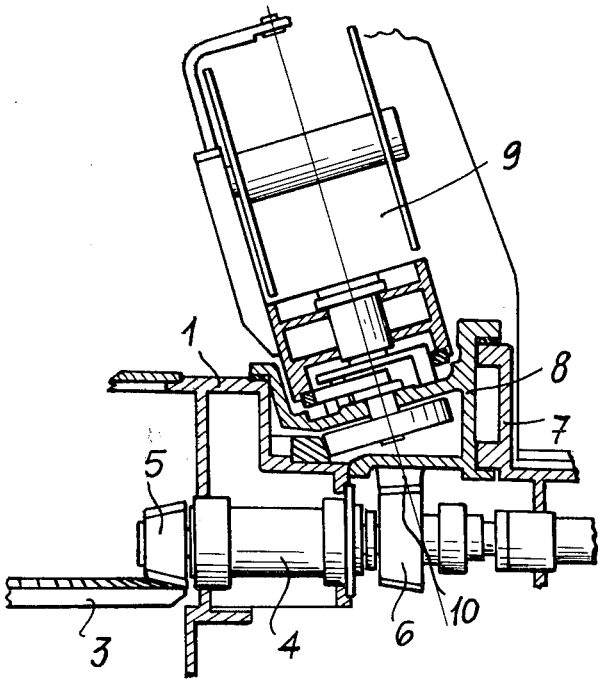

The threads 18 alternately transversing the circular path of spools 9 moving on said carriages 8, will pass through the spaces or gaps 19 left between said twelve pinions 5, 6 drawing the above described carriages 8, of which the details are shown in FIG. 5.

The formed strands will then pass into a pulley 102 to be supplied to a collecting and drawing unit 103, the latter being operated by the same drive shaft operating the entire machine.

It should be particularly noted that, as shown in FIG. 1, said axis or shaft 2 is internally hollow for arranging therein a core for the rope or cable to be formed. To this purpose, as fully schematically shown in FIG. 1, a unit 20 could be provided at underlying position, as comprising a spool or any other suitable means, for possible core insertion.

The operation of the machine will be apparent just from the foregoing description and accompanying drawings. However, such an operation can be briefly summarized in that, through the operating elements 100 and 101, said ring 3 is rotated, as well as axis or shaft 2 and, as a result, also said ring 11. Likewise, the collecting and drawing unit 103 is driven through the transmission shown. The rotation of ring 3 by said shafts 4 with the relevant pinions will move said carriages 8 carrying the respective spools 9 with the respective thread or strand along a circular path. At the same time, by means of shafts 12 said ring 11 will drive the thread guide device 13 which, as above mentioned, will upon cooperation of pinion or gear 15 with inner toothing ring 17 cause the alternate passage for thread 18 of stationary spools 14 within the spaces or apertures 19 provided on the circular track. As a result, the braid will be formed, the whole being then passed into pulley 102, in case around the core that could have been placed within said axis or shaft 2, to be then gathered in said unit 103.

The particular arrangement shown enables the production of twelve-strand ropes or cables by using all of the spools as provided.

On the other hand, instead of using all of such spools, should two stationary and two moving spools be excluded, eight-strand ropes or cables can be made. Similarly, by excluding four stationary and four moving spools, four-strand ropes or cables can be made.

It will be also readily understood that, on the ground of the same principle, machines could also be made as having a larger number of spools to form ropes or cables with more than twelve strands.

Therefore, it is apparent that the foregoing description given in connection with the accompanying drawings represents a mere embodiment and, accordingly, any variant and equivalent form made to the concept of the present invention is within the scope of the invention.

What I claim is:

1. A rotary braider comprising:

a stationary frame;

a circular guideway fixed to said frame;

a series of carriages movably mounted on said guideway, each of said carriages carrying a bobbin;

drive means for driving said series of carriages in a circular path defined by said guideway;

a plurality of spools disposed at fixed locations with respect to said frame;

a guide for collecting threads exiting said bobbins and said spools;

a plurality of thread guide devices for reciprocating the thread from said spools inside and outside said circular path and between adjacent ones of said carriages moving in said circular path, said thread guide devices each including a rotating element;

a central rotating member;

a gear ring affixed to said central rotating member;

a plurality of shafts operatively coupled to said gear ring, said shafts being disposed radially with respect to the axis of the central rotating member;

gears disposed at the ends of said shafts distal from said central rotating member; and gear means affixed to each of said carriages for engaging at least two of the gears at the distal ends of said shafts at any given time.

2. The braider according to claim 1, wherein said thread guide devices reciprocate the thread from said spools in a radial direction with respect to said central rotating member.

3. The braider according to claim 2, further including a second plurality of radially disposed shafts, said shafts engaging at one end thereof said central rotating member and at the distal ends thereof said thread guide devices for imparting reciprocating motion thereto.

4. The braider according to claim 3, wherein said central rotating member has an annular opening for passage of a core material to be braided.

5. The braider as claimed in claim 1, or 4 wherein each of said thread guide devices comprises an inner toothed ring and a gear rolling inside of said inner toothed ring, said inner toothed ring being of a double pitch diameter relative to that of the gear rolling within it.

* * * * *